United States Patent [19]

Snider

[11] Patent Number: 4,944,509

[45] Date of Patent: Jul. 31, 1990

[54] WEIGHTLIFTING BACKPACK

[76] Inventor: John M. Snider, 9544 Sarasota Dr., Knoxville, Tenn. 37923

[21] Appl. No.: 343,576

[22] Filed: Apr. 27, 1989

[51] Int. Cl.[5] ..... A63B 21/065

[52] U.S. Cl. ..... 272/119; 272/93; 272/123; 272/DIG. 9

[58] Field of Search ..... 272/93, 117, 119, 120, 272/121, 134, 139, DIG. 4, DIG. 9, 123

[56] References Cited

U.S. PATENT DOCUMENTS

| | | | |
|---|---|---|---|
| 3,322,425 | 5/1967 | Moore | 272/119 |
| 3,679,107 | 7/1972 | Perrine | 272/119 X |
| 4,213,605 | 7/1980 | McPeak | 272/119 |
| 4,332,379 | 6/1982 | Bannister | 272/119 |
| 4,641,836 | 2/1987 | Clifton | 272/123 X |
| 4,676,502 | 6/1987 | Mahr | 272/119 |
| 4,714,247 | 12/1987 | Gerstung | 272/93 X |
| 4,765,612 | 8/1988 | Henry, Jr. | 272/119 |
| 4,865,314 | 9/1989 | Carter, Jr. | 272/123 |

*Primary Examiner*—Richard J. Apley
*Assistant Examiner*—Joe H. Cheng
*Attorney, Agent, or Firm*—Luedeka, Hodges & Neely

[57] ABSTRACT

The invention is a rigid frame weightlifting exercise device that is worn by the user during weight training. The device accepts and securely holds standardized weights to the upper body of the wearer. The device is attached to the body by three straps, two about the shoulders and one about the waist, in the same manner as a mountaineer's backpack. The device also includes a stand to ease donning and removal of the backpack.

7 Claims, 4 Drawing Sheets

WEIGHTLIFTING BACKPACK

BACKGROUND OF THE INVENTION

Weight training or bodyshaping has increased in popularity in recent years. Muscle development is accomplished most commonly by lifting weights attached to various devices. The dumbbell, barbell, and a vast array of additional apparatus, from the simple weight bench to devices which require the user to sit or lie in them, are just a few which come to mind. These devices are expensive, large, and often require a second person for safety and to help the user as he or she trains to exhaustion. In addition, bodybuilders or bodyshapers have to fight boredom and the accompanying loss of interest in bodybuilding. Consequently, they look for variety in their exercise regimes. The subject device will address these issues.

A similar training device was patented on June 1, 1982 to Bannister, U.S. Pat. No. 4,332,379; however, it had limited commercial success, particularly among bodybuilders. The subject device will provide the features needed for use as a bodybuilding training apparatus and will provide easy donning and removal.

SUMMARY OF THE INVENTION

The invention is a backpack which is worn during bodyshaping exercises to increase the mass of the user's body. This added weight, requires the user's muscles to produce more force to move the weight of the user and the additional weight. This technique is easily applied to the following types of exercises: the push-up, the incline push-up, the pull-up, the chin-up, the behind the head pull-up, horizontal pull-up (which exercises the muscles across the back similar to a barbell row), dips (which exercise the triceps, pectorals, and latissimus dorsi), bend-over (which exercises the lower back muscles and hamstrings), sit-up, lunge, one leg-squat, and one leg toe raise. Nearly every muscle group can be trained using this invention.

The device accepts and rigidly holds standardized weights and attaches them to the body of the wearer in the same manner as a backpack. This allows the wearer complete use of his arms for upper body exercise and for support or balancing during lower body exercise. Since the user must move his or her body weight as well as the additional weight of the backpack during the exercise, the amount of weights required for a given exercise can be greatly reduced compared to most bodybuilding apparatus.

It is an object of this invention to provide a means to perform many of the exercises done in a gym in some other location with a minimum of expense, equipment, and weight. It is also an object of this invention to provide a simple, safe, and convenient manner to add additional weight to an athlete's body to increase the results of physical training.

Another object of this invention is to allow easy changes of added weight to the body during different parts of an exercise program.

Yet another object is to provide a rigid frame device which does not allow the user to move the spine in a potentially injurious manner during exercise, thereby reducing the possibility of back injury.

These and other objects, features, and advantages will be further refined, highlighted, and made apparent in the following detailed description of the disclosed embodiment and the appended drawings and claims.

DETAILED DESCRIPTION OF THE INVENTION

Figure 1:
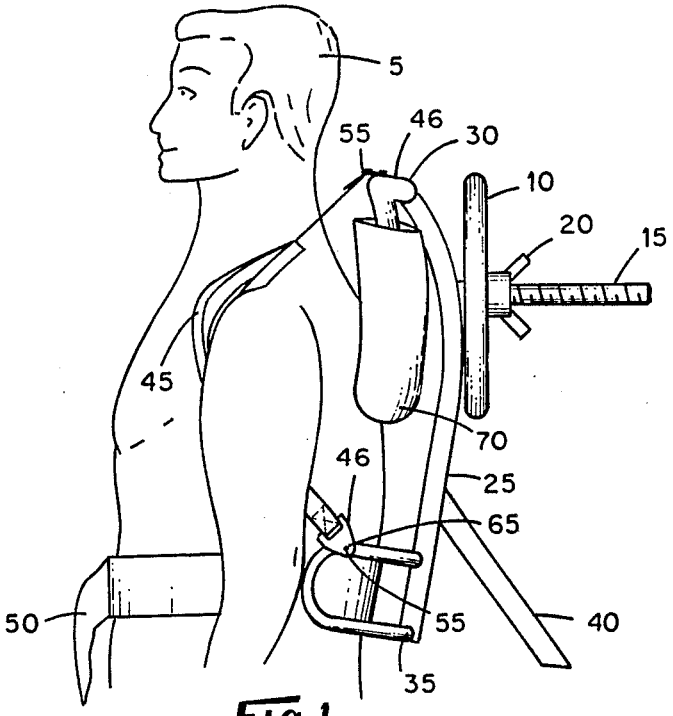
FIG. 1 is a view of the disclosed embodiment of the weight pack (the invention) being worn by a male user.

Turning now to the drawings, in which like numbers indicate like elements throughout the different figures, FIG. 1 depicts a man 5 wearing the rigid framed backpack weight lifting apparatus. A standard weight plate 10 is shown attached to the device. The plate 10 is shown placed over the threaded mild steel weight bar 15. The weight 10 is held firmly in place by the spin on weight nut 20. The weight bar 15 is welded to the mild steel upright bar 25. This upright bar is the back bone of the apparatus and supports the shoulder bar 30 and the lower torso bar 35, which are also composed of mild steel. The tail piece 40, composed of a mild steel one inch bar, is required to support the pack in an upright position when the pack is rested on the floor. Items 15 thru 40 will be referred to as the frame of the invention.

The frame is attached to the user by two straps and a belt. The left strap 45 is visible in FIG. 1. This strap is also equipped with a pad as shown in the figure. The belt is item 50. These straps and the waist belt are made of a nylon type webbing and have a buckle that provides provisions for changing the length of the shoulder straps and the waist belt, thereby accommodating various sized users. The ends of the shoulder straps 45 are attached to the shoulder bar 30 and the lower torso bar 35 by two steel pins 55 which pass through anchor plates 46 in the ends of the straps 45. The pins 55 then pass through holes 81 in the shoulder 30 and lower torso 35 bars and are secured by cotter pins 65, which pass through pin 55 (these holes and their location are portrayed in FIG. 2). The shoulder bar 30 is padded by a closed cell foam rubber pad 70 which provides the user with a comfortable load path from the weight 10 to the shoulder. The nylon type belt 50 is also equipped with a buckle that provides size adjustment like the straps 45; the buckle also allows fast release and fastening of the belt about the waist of the user. The attachment points of the belt 50 and of the straps 45 are best seen in FIG. 2.

Figure 2:
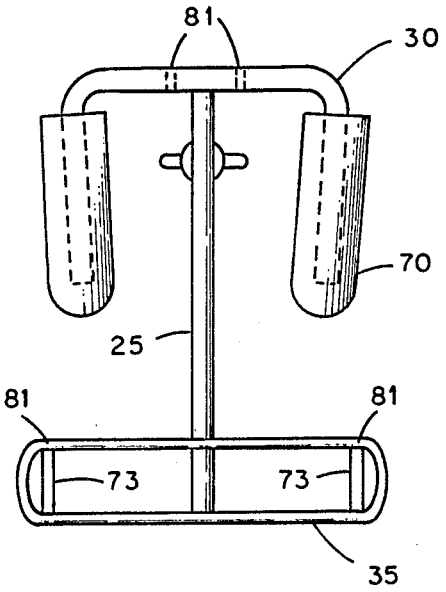
FIG. 2 depicts the front view of the rigid frame without the straps and belt shown.

FIG. 2 depicts all of the frame components 15 thru 40 and the mild steel belt bars 73, which were hidden by the belt 50 in FIG. 1. The four holes 81 for pins 55 which secure the anchor plates 46 to the frame can also be seen in this figure. The portions of the shoulder bar 30 that are hidden by the shoulder pads 70 are also portrayed in FIG. 2.

FIG. 3 portrays the shoulder straps (45 in FIG. 1) and the waist belt (50 in FIG. 1) with greater detail than FIG. 1. The shoulder strap is shown in two pieces and in two views. The front view and the side view of the upper portion of strap are shown in FIGS. 3C and 3D respectively. The lower portion of the strap is depicted in FIGS. 3E and 3F. The belt is also shown in two views, the front (FIG. 3A) and the top (FIG. 3B). Broken lines indicate visible sewing or stitching lines.

The lower strap (FIG. 3E & 3F) consists of one inch wide nylon webbing 47 and mild steel strap anchor 46. The upper portion of the shoulder strap (FIGS. 3C & 3D) includes a strap buckle 49, which allows adjustment of the length of shoulder strap, the upper one inch wide nylon webbing 47, the shoulder pad 48 and the upper mild steel anchor plate 46. The pad 48 is composed of closed cell foam rubber covered in fabric reinforced vinyl material.

Figure 3A:
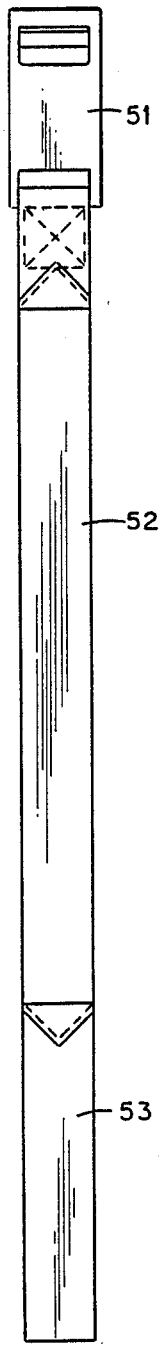
FIG. 3 is a group of detailed figures of the waist belt and the shoulder straps.
Figure 3B:
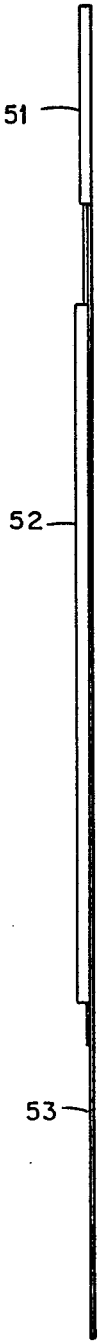
Figure 3C:
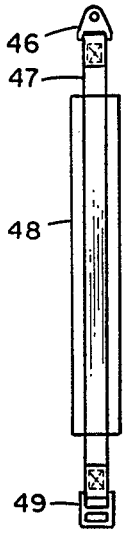
Figure 3D:
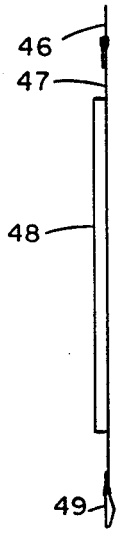
Figure 3E:
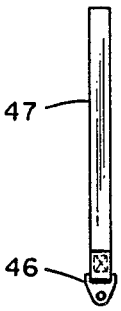
Figure 3F:
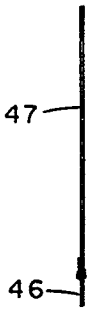

The waist belt (50 in FIG. 1) is shown in FIGS. 3A and 3B. The belt consists of three inch wide nylon webbing 53, the waist belt pad 52 is made of closed cell foam rubber covered in fabric reinforced vinyl material, and the engineering plastic buckle 51. The lower end of the webbing 53 is laced through the upper end of the buckle. The length of the belt can then be adjusted by changing the amount of webbing laced in the buckle. The buckle also can be released to provide rapid removal of the belt.

Figure 4A:
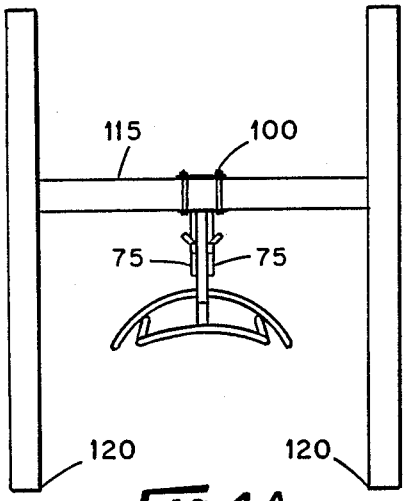
FIG. 4 illustrates the frame of the weight pack in a donning stand in three principal views.
Figure 4B:
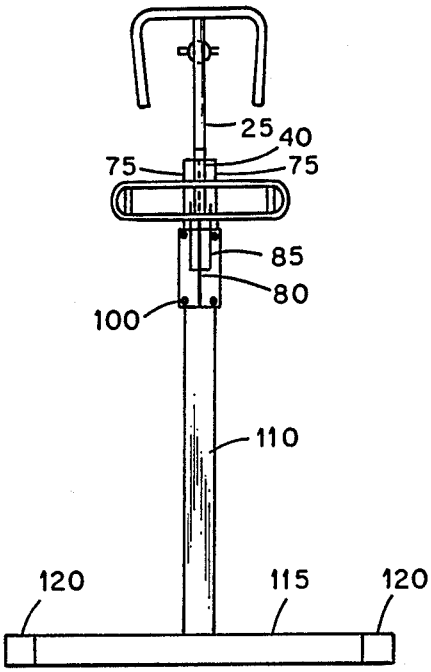
Figure 4C:
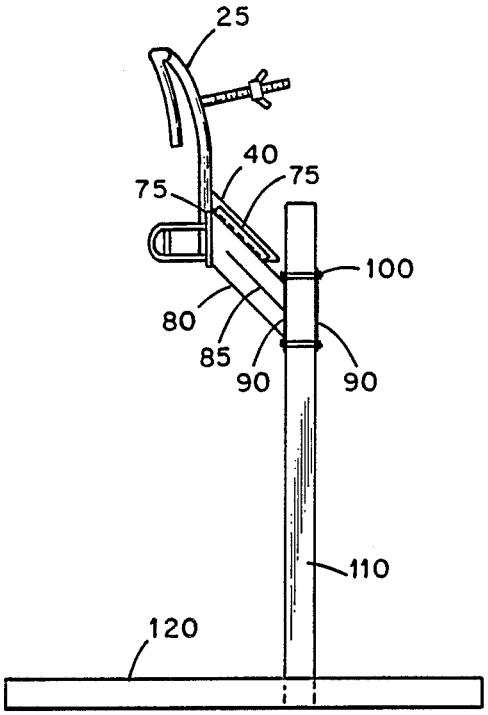

The donning stand is illustrated in FIG. 4; a top (FIG. 4A),a front (FIG. 4B), and a side (FIG. 4C) have been included. FIG. 4 also shows the frame in the stand to portray how the stand holds the frame. The stand holds the frame by the upright 25 and the tail piece 40. The support pads 75 are two pieces of one inch inside diameter pipe cut in half length wise; these pads fit around the tail piece 40 and upright 25. The downward weight of the frame keeps the frame in contact with the support pads 75. The curvature of the pads keep the frame still when any side moments are applied to it, as in during donning. The support pads 75 are welded to a $\frac{1}{8}$ inch mild steel plate 80 called the support member. The support member is strengthened by two mild steel gusset plates 85. The support member and the gusset plates are welded to a bolt plate 90. A second bolt plate is used to sandwich the stand upright 110. The tension from the bolts 100 on the two plates 90 keeps the support members 90,85,80,75 and the frame in position the stand upright. The height of the frame is adjusted by using a wrench to loosen the nuts and by moving the bolt plates up and down the upright 110 until the correct height is found. The nuts are then retightened to prevent movement.

The donning stand frame members include the stand upright 110, the cross brace 115, and the two stand legs 120. These structural members of the stand are composed of 18 gauge mild steel three inch square tubing.

The athlete adjusts the height of the donning stand to accommodate his or her stature then places both arms through the two straps. The athlete may then affix the belt about the waist or raise up roughly $\frac{3}{4}$ of an inch and move away from the support pads and then affix the belt.

The preceding detailed description has related one of many possible ways of designing the pack frame, the shoulder straps, the waist belt, and the donning stand. An infinite variation of the foregoing apparatus is possible and consequently would violate the spirit of this invention. To define the core of this invention I make the following claims:

What is claimed:

1. A weight lifting device for firmly securing standardized barbell weights having a central hole extruding therethrough to the upper posterior portion of a user's body, said device comprising:

a back frame including (a) a shoulder-spanning portion for extending across the upper portion of a user's back from a location adjacent the user's right shoulder to a location adjacent the user's left shoulder;

(b) a lower back-spanning portion for extending across the lower back of the user from a location adjacent the user's right side to a location adjacent the user's left side; and (c) elongate means for connecting the shoulder-spanning portion to the lower back-spanning portion including upper and lower ends, said elongate means fixed at its upper end to the shoulder-spanning portion and fixed at its lower end to the lower back-spanning portion and extending generally along the center of the user's back when the device is operatively worn;

a weight-carrying bar associated with the frame about which standardized barbell weights can be positioned, said weight-carrying bar being fixed to the frame so as to project generally rearwardly thereof from a location adjacent the upper end of the elongate means and adapted to receive the weights placed thereon as the hole in each weight is directed onto the rearwardly-projecting end of the weight-carrying bar and the weight is positioned adjacent the frame;

clamp means associated with the weight-carrying bar for securing the weights in place along length of the weight-carrying bar; and strap means securable about the frame for firmly securing the frame against the back of the user so that when the frame is firmly secured against the user's back, the center of gravity of the weights positioned on the weight-carrying bar is located adjacent the user's back at a location substantially midway between the user's shoulder blades.

2. The device of claim 1 wherein the weight-carrying bar is a threaded rod and the clamp means includes a nut threadable about the rod.

3. The device of claim 1 wherein said strap means includes a waist belt connected to the lower back-spanning portion and a pair of shoulder straps connected to the shoulder-spanning portion, and each of said waist belt and shoulder straps are padded to enhance the wearing comfort of the device.

4. The device of claim 3 wherein said waist and shoulder straps can be adjusted in length to permit the device to be worn by an user having a build within a range of build sizes and wherein each of said waist and shoulder straps includes means to releasably secure the corresponding strap about the user's torso.

5. The device of claim 1 wherein the frame is padded in regions where it contacts the user's back when worn to enhance the wearing comfort of the frame.

6. The device of claim 1 further comprising a stand for supporting said device in an upright position when not in use upon an underlying support surface and for facilitating the donning of the device upon a user and the removal of the device from a user.

7. The device of claim 6 wherein said stand including means for accommodating an adjustment in position of the device upon the stand relative to the underlying support structure to facilitate the donning of the device by users of different heights.

* * * * *